US009434174B2

(12) United States Patent
Ujita et al.

(10) Patent No.: US 9,434,174 B2
(45) Date of Patent: Sep. 6, 2016

(54) INK TANK AND PRINTING APPARATUS

(71) Applicant: CANON KABUSHIKI KAISHA, Tokyo (JP)

(72) Inventors: Toshihiko Ujita, Yokohama (JP); Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/858,983

(22) Filed: Sep. 18, 2015

(65) Prior Publication Data

US 2016/0089894 A1 Mar. 31, 2016

(30) Foreign Application Priority Data

Sep. 25, 2014 (JP) ..... 2014-194728

(51) Int. Cl.
*B41J 29/393* (2006.01)
*B41J 2/175* (2006.01)

(52) U.S. Cl.
CPC ..... *B41J 2/17546* (2013.01)

(58) Field of Classification Search
CPC ..... B41J 2/17546
See application file for complete search history.

(56) References Cited

FOREIGN PATENT DOCUMENTS

JP 2011-93328 A 5/2011
JP 2012-121180 A 6/2012

*Primary Examiner* — Julian Huffman
(74) *Attorney, Agent, or Firm* — Canon USA, Inc. I.P. Division

(57) ABSTRACT

A light emitting portion of an ink tank emits light after a delay time in accordance with a mounting speed of the ink tank has elapsed after connecting second electrode pads on an ink tank side and a second contact on a holder side.

20 Claims, 9 Drawing Sheets

FIG. 8

| EXAMPLE | r1 | r2 | h | d | TIME DIFFERENCE Δt [sec] CORRESPONDING TO OPERATION SPEED v (UPPER ROW) [mm/sec] | | | |
|---|---|---|---|---|---|---|---|---|
| | [mm] | [mm] | [mm] | [mm] | 0.1 | 1 | 10 | 100 |
| 1 | 65 | 70 | 5 | 0.38 | 3.85 | 0.38 | 0.04 | 0.00 |
| 2 | 65 | 70 | 10 | 0.77 | 7.69 | 0.77 | 0.08 | 0.01 |
| 3 | 65 | 70 | 15 | 1.15 | 11.54 | 1.15 | 0.12 | 0.01 |
| 4 | 50 | 55 | 5 | 0.50 | 5.00 | 0.50 | 0.05 | 0.01 |
| 5 | 50 | 55 | 10 | 1.00 | 10.00 | 1.00 | 0.10 | 0.01 |
| 6 | 50 | 55 | 15 | 1.50 | 15.00 | 1.50 | 0.15 | 0.02 |
| 7 | 45 | 50 | 5 | 0.56 | 5.56 | 0.56 | 0.06 | 0.01 |
| 8 | 45 | 50 | 10 | 1.11 | 11.11 | 1.11 | 0.11 | 0.01 |
| 9 | 45 | 50 | 15 | 1.67 | 16.67 | 1.67 | 0.17 | 0.02 |

INK TANK AND PRINTING APPARATUS

BACKGROUND

1. Field of the Disclosure

Aspects of the present disclosure generally relates to an ink tank provided with a function of notifying information with light and the like and relates to a printing apparatus capable of mounting the ink tank.

2. Description of the Related Art

A serial scan inkjet printing apparatus described in Japanese Patent Laid-Open No. 2011-93328 is configured to, with a light emitting portion provided in an ink tank, notify that fixing of an ink tank to a carriage has been completed. Contacts that are connected to the light emitting portion are disposed at portions where the ink tank and the carriage oppose each other such that when mounting the ink tank in the carriage, the fixing of the ink tank is completed after the contacts are connected.

SUMMARY

An ink tank of the present disclosure is capable of being mounted in a mount portion and includes a tank side contact that is capable of being connected to a mount portion side contact provided on a mount portion, and a notifying portion that is capable of performing a notification operation. When the ink tank is mounted on the mount portion, the notifying portion performs the notification operation after a delay time, the delay time being set in accordance with a mounting speed of the ink tank, has elapsed from when the tank side contact has been connected to the mount portion side contact.

Further features of the present disclosure will become apparent from the following description of exemplary embodiments with reference to the attached drawings.

BRIEF DESCRIPTION OF THE DRAWINGS

FIG. 8 is a chart describing the time differences Δt of the ink tanks having different exemplary configurations.

DESCRIPTION OF THE EMBODIMENTS

In Japanese Patent Laid-Open No. 2011-93328, when the light emitting portion is made to emit light after waiting for the contacts at the portions where the ink tank and the carriage oppose each other are connected to each other, the light emitting portion will emit light before the fixing operation of the ink tank is completed. In particular, in a case in which a user, who is not accustomed to handling the ink tank, slowly mounts the ink tank taking a long time, the mounting operation of the ink tank will be completed after elapse of a considerable time after the light emitting portion has emitted light. In such a case, the user may stop the mounting job of the ink tank although the mounting operation of the ink tank has not been completed and, disadvantageously, the mounting operation of the ink tank may be left uncompleted.

Meanwhile, Japanese Patent Laid-Open No. 2012-121180 describes a configuration in which, when mounting an ink tank, a signal for detecting the mounting of the ink tank is delayed by a set time with a delay member provided on the ink tank so as to increase the detection accuracy when the ink tank is swiftly mounted. However, since the delay time is fixed, when the ink tank is mounted taking a longer time than the delay time, for example, completion of the mounting operation of the ink tank will be after the mounting of the ink tank has been detected. Accordingly, there is still a possibility of the user stopping the mounting job of the ink tank although the mounting operation of the ink tank has not been completed and the mounting operation of the ink tank being disadvantageously left uncompleted.

The present disclosure provides an ink tank and a printing apparatus that are capable of reliably notifying the completion of a mounting operation of an ink tank regardless of the way the ink tank is mounted by the user.

Hereinafter, exemplary embodiments of the present disclosure will be described with reference to the drawings.

Figure 1:
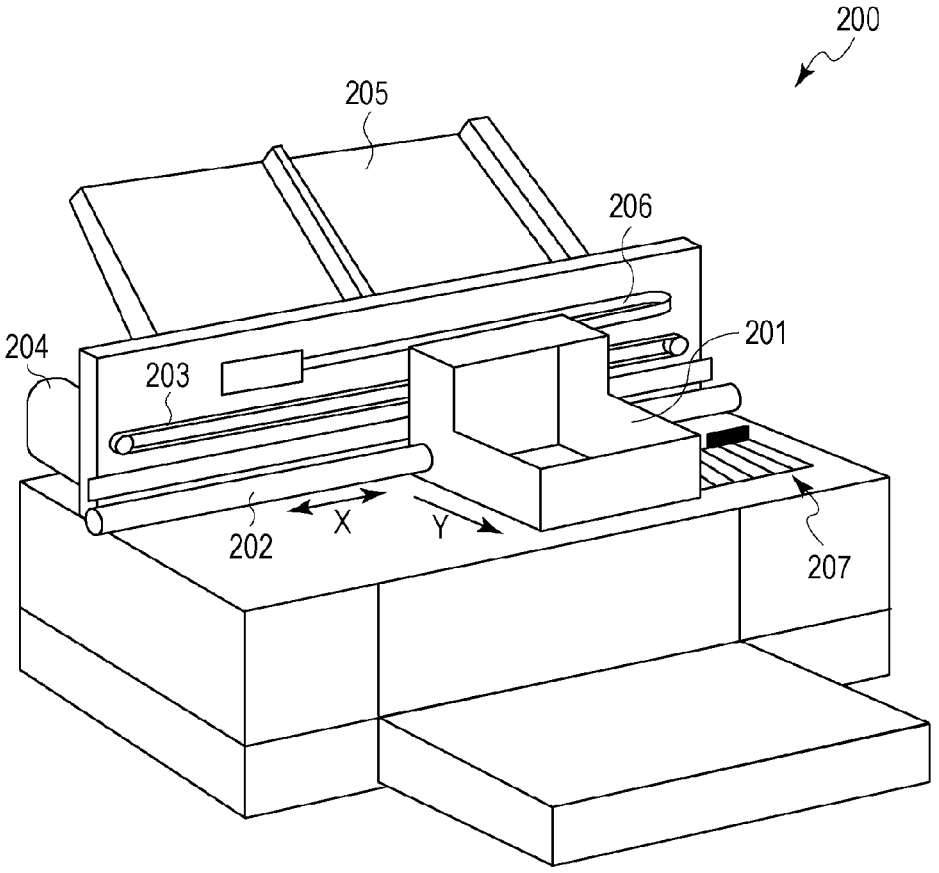
FIG. 1 is a perspective view of a printing apparatus to which the present disclosure can be applied.

FIG. 1 is a perspective view for describing an exemplary configuration of an inkjet printing apparatus 200 to which the present disclosure can be applied. The printing apparatus 200 of the present exemplary embodiment is a so-called serial scan printing apparatus and, as described later, is provided with a carriage 201 that is capable of mounting inkjet print heads and ink tanks. The carriage 201 is guided by a guide shaft 202 so as to be movable in a main scanning direction (an arrow X direction) and is connected to a belt 203. By turning the belt 203 with a carriage motor 204, the carriage 201 is reciprocally moved in the main scanning direction. A sheet (a record medium, not shown) that is loaded on a sheet feeding portion 205 is conveyed with a conveying roller (not shown) in a sub scanning direction (an arrow Y direction) that intersects (orthogonal in the present exemplary embodiment) the main scanning direction. A flexible cable 206 is connected between the carriage 201 and a controller (not shown) of the printing apparatus 200. The inkjet print heads and the ink tanks mounted in the carriage 201 are electrically connected to the controller of the printing apparatus 200 through the flexible cable 206.

The inkjet print heads each eject ink through a discharge opening in a nozzle tip by using a discharge energy generating element such as an electrothermal transducer element (a heater) or a piezo element. In a case in which an electrothermal transducer element is used, bubbles are generated in the ink with the heat generated by the electrothermal transducer element, and the bubble generating energy is used to eject the ink from the discharge opening. The printing apparatus 200 is provided with a recovery process portion 207 including a cap and a wiper blade in order to perform a recovery process that favorably maintains the ink discharge condition of the above kind of print head. The printing apparatus 200 records an image on the record medium by moving the carriage 201 together with the print heads in the main scanning direction (the arrow X direction) while performing an operation of ejecting ink from the print heads and conveying the record medium in the sub scanning direction (the arrow Y direction).

Figure 2A:
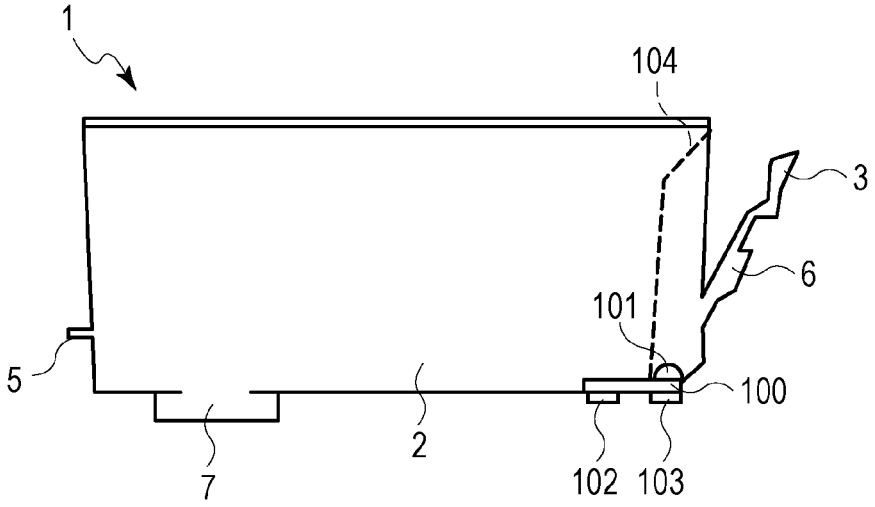
FIGS. 2A and 2B are explanatory drawings of an ink tank of an exemplary embodiment of the present disclosure.
Figure 2B:
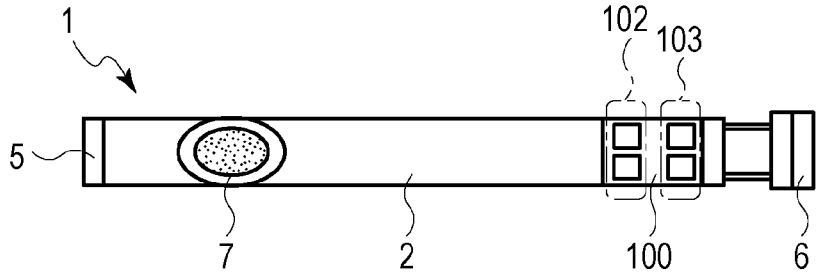

FIGS. 2A and 2b are explanatory drawings of an ink tank 1. The ink tank 1 is mounted in the carriage 201 through a holder described later. The ink tank 1 of the present exemplary embodiment is of a cartridge type that is detachable with respect to the holder described later and is also referred to as an ink cartridge.

A support member (an elastic lever) 3 is located on a front side (the right side in FIG. 2A) of the ink tank 1, and the support member 3 is integrally formed with a casing 2 of the ink tank 1 with a resin material. As engagement portions on the ink tank side (tank side engaging portions), a first engagement portion (a tank side first engagement portion) 5 and a second engagement portion (a tank side second engagement portion) 6 are provided on the ink tank 1. The first engagement portion 5 is provided on a back surface (another lateral surface) that is opposite a front surface of the ink tank 1 and that is adjacent to a bottom surface of the ink tank 1, so as to form a first protrusion, and the second engagement portion 6 is provided in an integrated manner with the support member 3 so as to form a second protrusion. The support member 3 is provided on the front surface (a lateral surface) of the ink tank 1. An ink supply opening 7 that supplies ink by being joined to the ink introduction opening of the print head described later is provided on the bottom surface (the lower side in FIG. 2A) of the ink tank 1. A proximal end portion of the support member 3 on the lower side is located where the bottom surface of the ink tank 1 and the adjacent front surface of the ink tank 1 intersect each other. Furthermore, a chip-shaped or a plate-shaped substrate 100 is provided on the bottom surface that intersects the front surface of the ink tank 1. The substrate 100 of the present exemplary embodiment is a plate-shaped substrate. A plurality of electrode pads (tank side contact) including first electrode pads (tank side first contact) 102 and second electrode pads (tank side second contact) 103 are provided on a surface of the substrate 100 facing the outside of the ink tank 1. Meanwhile, a light emitting portion (a notifying portion) 101 that notifies information by emitting visible light and a control unit that controls the light emitting portion 101 are provided on a surface of the substrate 100 facing the inside of the ink tank 1. An LED may be cited as a representative example of the light emitting element.

Figure 3A:
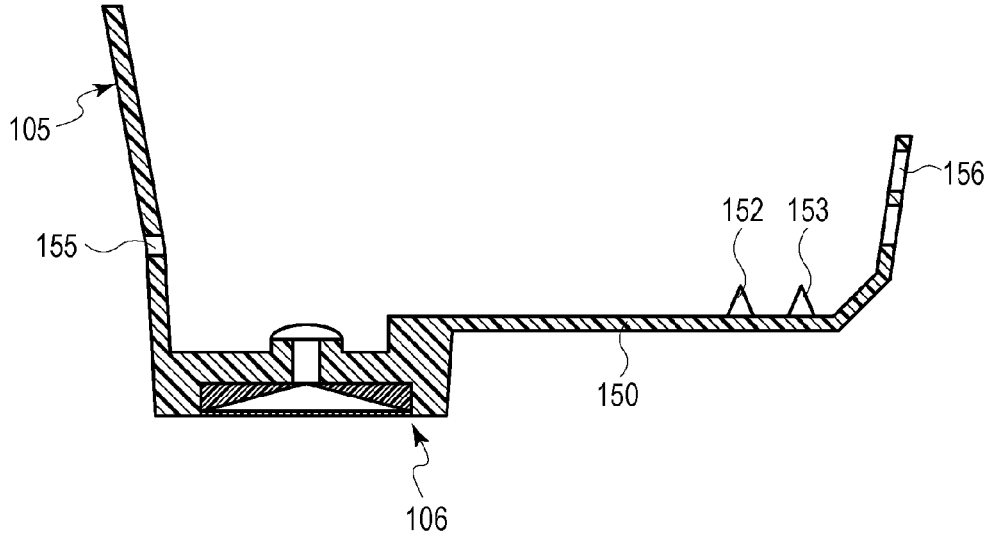
FIGS. 3A and 3B are explanatory drawings of a print head unit in which the ink tank of FIGS. 2A and 2B can be mounted.
Figure 3B:
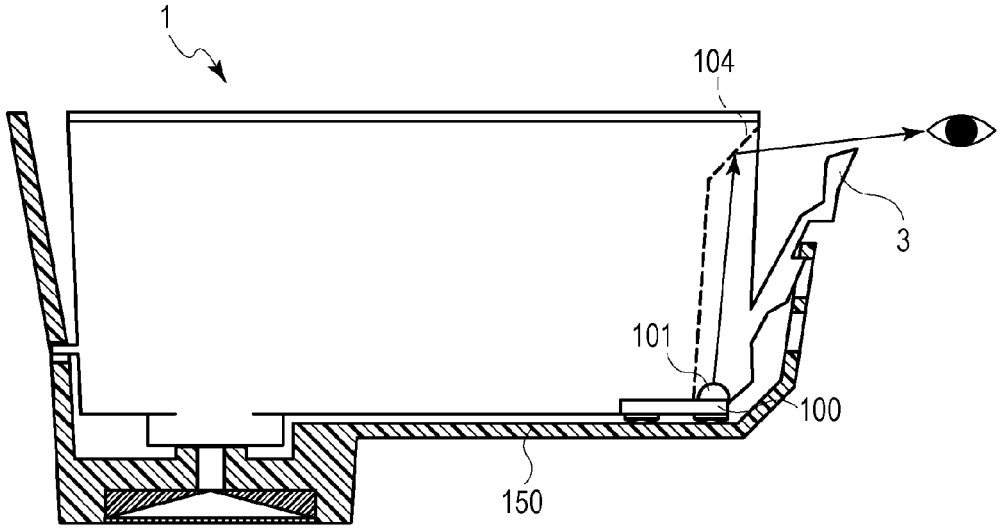

FIGS. 3A and 3B are explanatory drawings of a holder 150. Each ink tank 1 is mounted in the carriage 201 through the holder 150. The holder 150 of the present exemplary embodiment includes inkjet print heads 106 as well as print head units 105. As described above, each print head 106 ejects ink through the discharge opening in the nozzle tip by using the discharge energy generating element such as an electrothermal transducer element (a heater) or a piezo element. The discharge openings each form a discharge opening array by being arranged in a plural number in a direction that intersects (orthogonal in the present exemplary embodiment) the main scanning direction.

A first lock portion (a mount portion side first engagement portion) 155 that forms a first hole portion and a second lock portion (a mount portion side second engagement portion) 156 that forms a second hole portion are provided in the inner surface of the holder 150 as a holder side engagement portion (mount portion side engagement portion). The first lock portion 155 and the second lock portion 156 are capable of engaging with the first engagement portion 5 and the second engagement portion 6 on the ink tank 1 side, respectively. As illustrated in FIG. 3B, by having the above engaged with each other, the ink tank 1 is mounted in and fixed to the holder 150. A plurality of contacts including a first contact (a mount portion side first contact) 152 and a second contact (a mount portion side second contact) 153 serving as a holder side contact (mount portion side contact) are provided on an inner bottom surface of the holder 150 that opposes the bottom surface of the ink tank 1. As illustrated in FIG. 3B, when the ink tank 1 is fixed to the holder 150, the first contact 152 and the second contact 153 are capable of being electrically connected to the first electrode pads 102 and the second electrode pads 103 on the ink tank 1 side. When the holder 150 is mounted in the carriage 201, the first contact 152 and the second contact 153 on the holder 150 side are electrically connected to the controller of the printing apparatus 200 through a contact (not shown) on the carriage 201 side and the flexible cable 206. The holder 150 is detachable with respect to the carriage 201, and the ink tank 1 is detachable with respect to the holder 150.

The control unit of the ink tank 1 controls the light emission of the light emitting portion 101 on the basis of an electric signal supplied through the first contact 152 and the second contact 153 on the holder 150 side and the first electrode pads 102 and the second electrode pads 103 on the ink tank 1 side. As described above, the substrate 100 is disposed on the bottom surface side where the bottom surface and the front surface of the ink tank 1 intersect with each other. Furthermore, an inclined surface 104 is formed on the ink tank 1 such that when the light emitting portion 101 emits light, a portion of the light is projected along the inclined surface 104 and to the outside from the front side (the right side in FIG. 3B) of the ink tank 1.

By using the above substrate 100 and the light guide path, various pieces of information can be optically notified to the printing apparatus 200, a host apparatus such as a computer that is connected to the printing apparatus 200, and the user. In other words, at an end portion of the moving range of the carriage 201, by capturing the light emitting state of the light emitting portion 101, a light receiving element (not shown) that is disposed in the printing apparatus 200 or the user can recognize the information corresponding to the light emitting state. The information may include a piece of information on whether the mounting of the ink tank 1 has been completed, for example. Furthermore, the information may include, when the holder 150 is provided with mount portions for ink tanks each corresponding to an ink among inks of a plurality of colors, a piece of information on whether the ink tanks are each correctly mounted in a mount portion of the corresponding ink. Furthermore, the information may include a piece of information on whether the amount of ink remaining inside each ink tank is sufficient or not. The above pieces of information may be notified by emitting or not emitting light from the light emitting portion 101 and by the state of the emitted light such as a flashing state.

FIGS. 4A, 4B, 5A, and 5B are diagrams for describing an operation performed when mounting the ink tank 1 in the holder 150 of the print head unit 105 mounted in the carriage 201. By mounting the ink tank 1 in the holder 150, an ink introduction opening 107 on the print head 106 side that is located in the bottom portion of the holder 150 and the ink supply opening 7 on the ink tank 1 side are joined together and a communication path of the ink is formed therebetween.

Figure 4A:
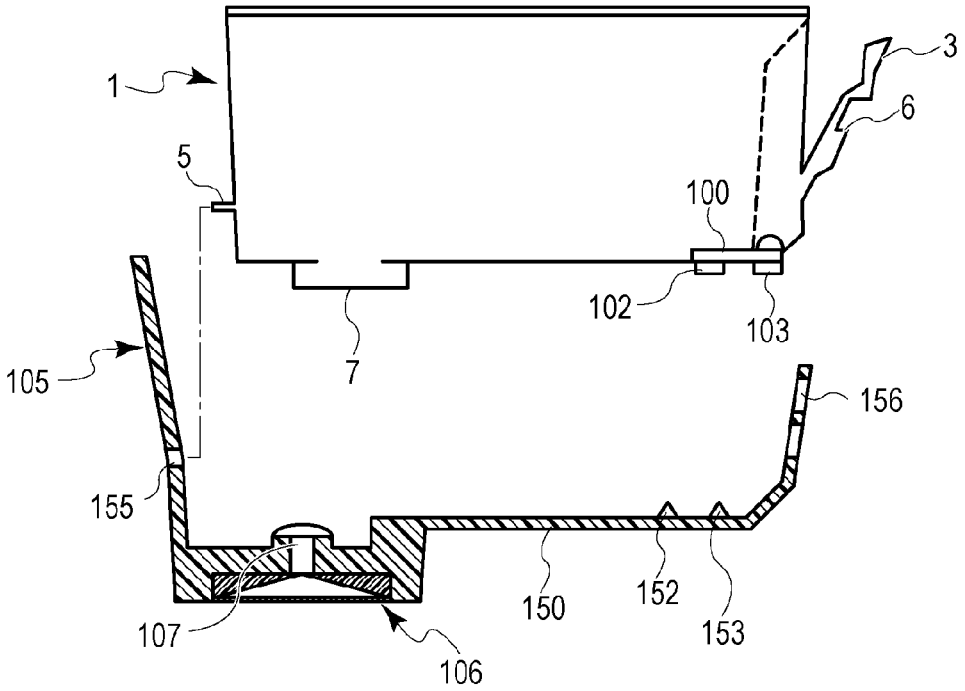
FIGS. 4A and 4B are explanatory drawings of a mount operation of the ink tank.
Figure 4B:
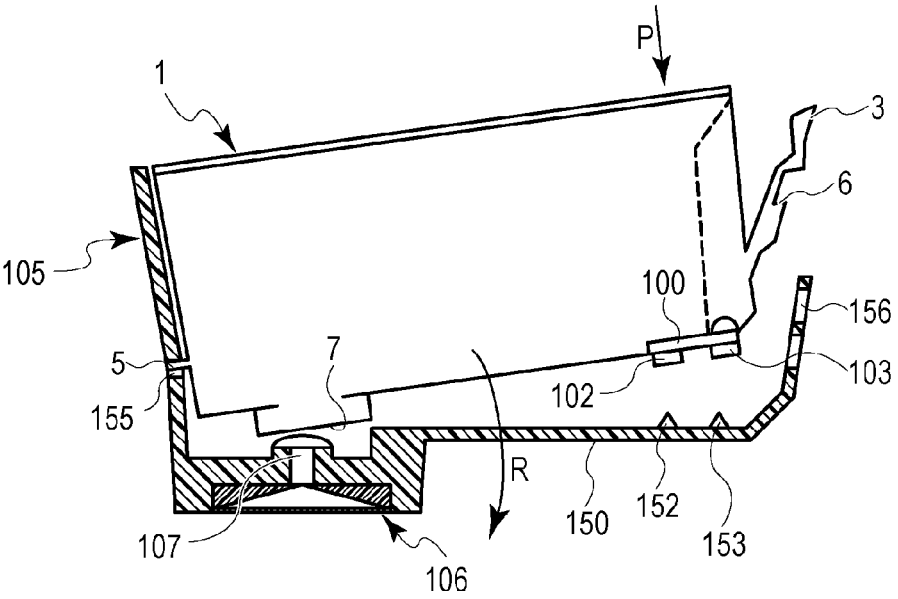
Figure 5A:
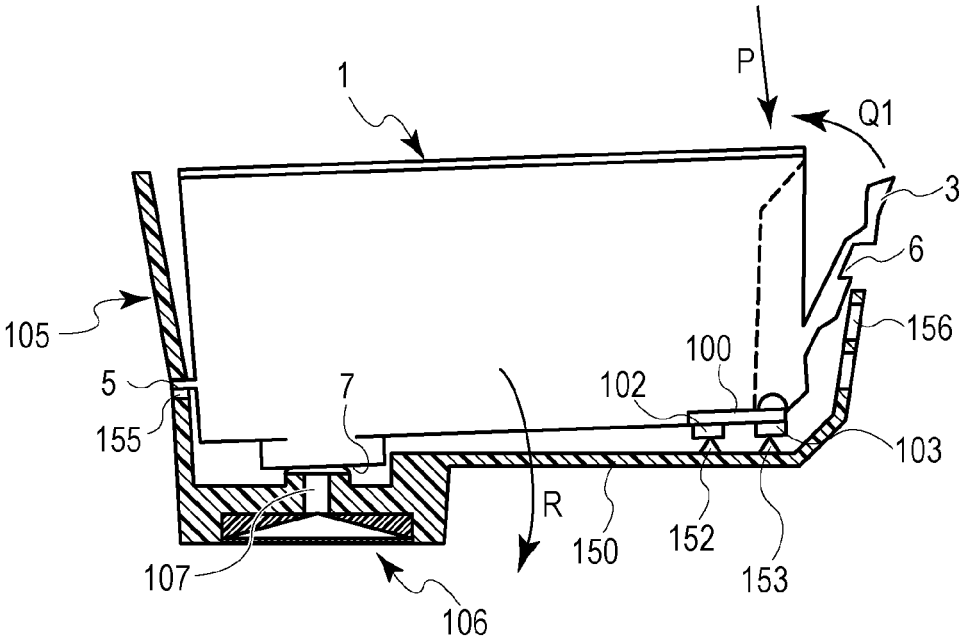
FIGS. 5A and 5B are explanatory drawings of the mount operation of the ink tank.

When mounting the ink tank 1 in the holder 150, as illustrated in FIG. 4A, the ink tank 1 is first positioned above the holder 150. Next, as illustrated in FIG. 4B, the protrusion-like first engagement portion 5 provided on the back side of the ink tank 1 is engaged with the through hole-like first lock portion 155 provided on the back side of the holder 150 such that the ink tank 1 is located on the bottom surface of the holder 150. From the above state, when the upper front end of the ink tank 1 is pressed down as illustrated by the arrow P, the ink tank 1 pivots in the arrow R direction about the engagement portion between the first engagement portion 5 and the first lock portion 155 serving as a pivot fulcrum, and the front side of the ink tank 1 is displaced downwards. In the course of the above, the lateral surface of the second engagement portion 6 provided on the support member 3 on the front side of the ink tank 1 is, as illustrated in FIG. 5A, pushed against the second lock portion 156 provided on the front side of the holder 150, and the support member 3 is elastically deformed towards the arrow Q1 direction.

Figure 5B:
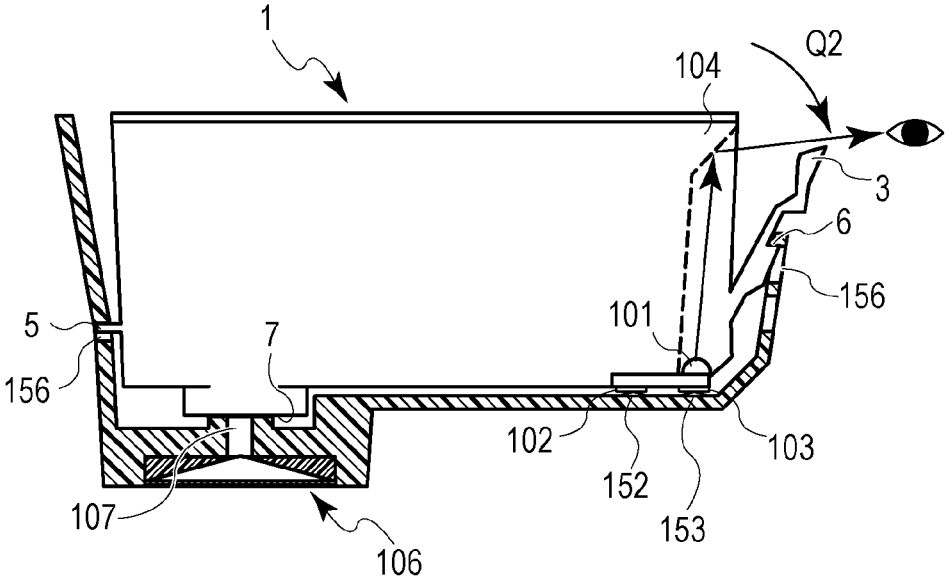

Then, when the upper surface of the second engagement portion 6 becomes positioned below the second lock portion 156, as illustrated in FIG. 5B, the support member 3 returns in the arrow Q2 direction by the elastic restoring force of the support member 3 itself, and the second engagement portion 6 becomes locked to the second lock portion 156. In the above state, the second lock portion 156 horizontally biases the ink tank 1 towards the back side (the left side in FIG. 5B) through the support member 3 and abuts the back surface of the ink tank 1 against the back side of the holder 150. Upwards displacement of the ink tank 1 is suppressed by the engagement between the first engagement portion 5 and the first lock portion 155 and the engagement between the second engagement portion 6 and the second lock portion 156. Mounting of the ink tank 1 is completed in the above manner.

When mounting of the ink tank 1 is completed in the above manner, as illustrated in FIG. 5B, the ink supply opening 7 and the ink introduction opening 107 are joined together, the first contact 152 and the first electrode pads 102 are electrically connected to each other, and the second contact 153 and the second electrode pads 103 are electrically connected to each other. With such electrical connections, the light emitting portion 101 disposed on the substrate 100 becomes capable of being turned on. Furthermore, when mounting of the ink tank 1 is completed, the elastic restoration of the first engagement portion 5 and the second engagement portion 6 are suppressed with the first lock portion 155 that is engaged with the first engagement portion 5, and the second lock portion 156 that is engaged with the second engagement portion 6 so as to prevent the ink tank 1 from being lifted upwards. In other words, the first engagement portion 5 and the second engagement portion 6 are kept in an appropriately elastically deformed state. As will be described later, a time difference ΔT is set based on a time difference Δt between the connection time of the first contact 152 and the first electrode pads 102 and the connection time of the second contact 153 and the second electrode pads 103, and the light emitting portion 101 is turned on the basis of the time difference ΔT.

The operations from FIGS. 4B to 5B are not performed at the same time. In other words, by a slight time difference Δt after the first contact 152 and the first electrode pads 102 are connected to each other, the second contact 153 and the second electrode pads 103 are connected to each other, and after that, by a slight time difference ΔT, the second engagement portion 6 and the second lock portion 156 are engaged with each other. In the present exemplary embodiment, the time difference ΔT is obtained from the time difference Δt, and the light emitting portion 101 is turned on at a timing corresponding to the time difference ΔT to notify that mounting of the ink tank 1 has been completed. In order for the above, the first contact 152, the first electrode pads 102, the second contact 153, and the second electrode pads 103 are geometrically arranged so that the first contact 152 and the first electrode pads 102 come into contact with each other before the second contact 153 and the second electrode pads 103 come into contact with each other.

Figure 6A:
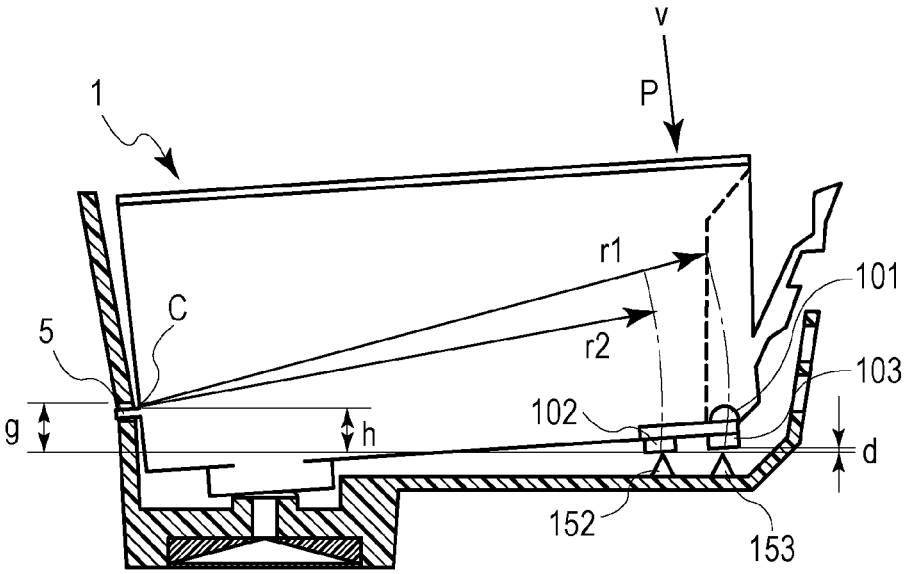
FIGS. 6A and 6B are explanatory drawings illustrating states in which the ink tank is in the middle of the mount operation.
Figure 6B:
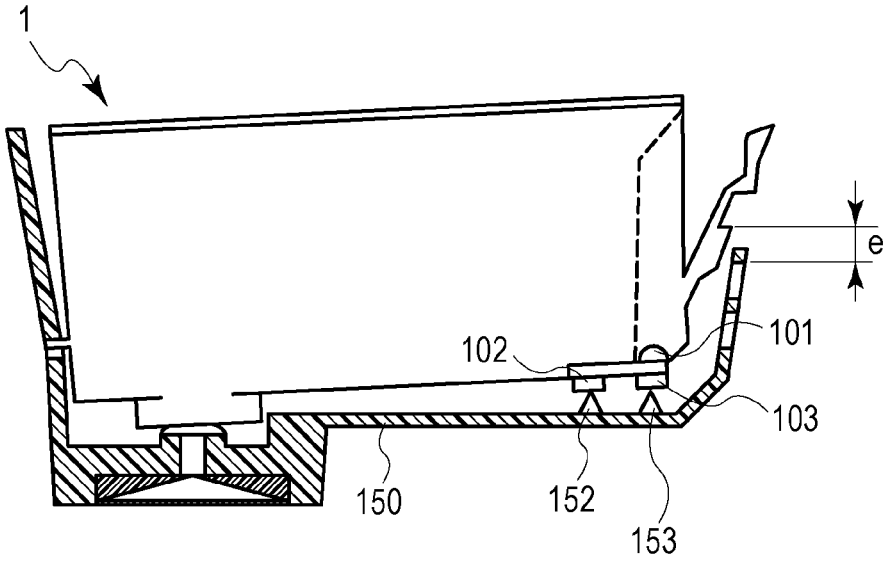

FIGS. 6A and 6B are drawings illustrating the time difference Δt.

FIG. 6A illustrates a state immediately after the first contact 152 and the first electrode pads 102 have come into contact with each other after the first engagement portion 5 and the first lock portion 155 had engaged with each other. From the above state, a distance d for the ink tank 1 to move exists until the second contact 153 and the second electrode pads 103 come into contact with each other. In FIG. 6A, r1 is a pivot radius of the second contact 153 about a pivot fulcrum C of the engagement portion between the first engagement portion 5 and the first lock portion 155, and r2 is a pivot radius of the first contact 152 about the pivot fulcrum C. Reference sign g corresponds to the distance in the up-down direction in the drawing between the pivot fulcrum C and the first and second electrode pads 102 and 103 and corresponds to the distance in the up-down direction in the drawing between the pivot fulcrum C and the contact position of the first contact 152 and the first electrode pads 102. Reference sign h is the distance in the height direction of the ink tank 1 from the pivot fulcrum C to the first and second electrode pads 102 and 103 and corresponds to the distance between the pivot fulcrum C and the contact position between the first contact 152 and the first electrode pads 102 in the height direction of the ink tank 1.

Figure 7:
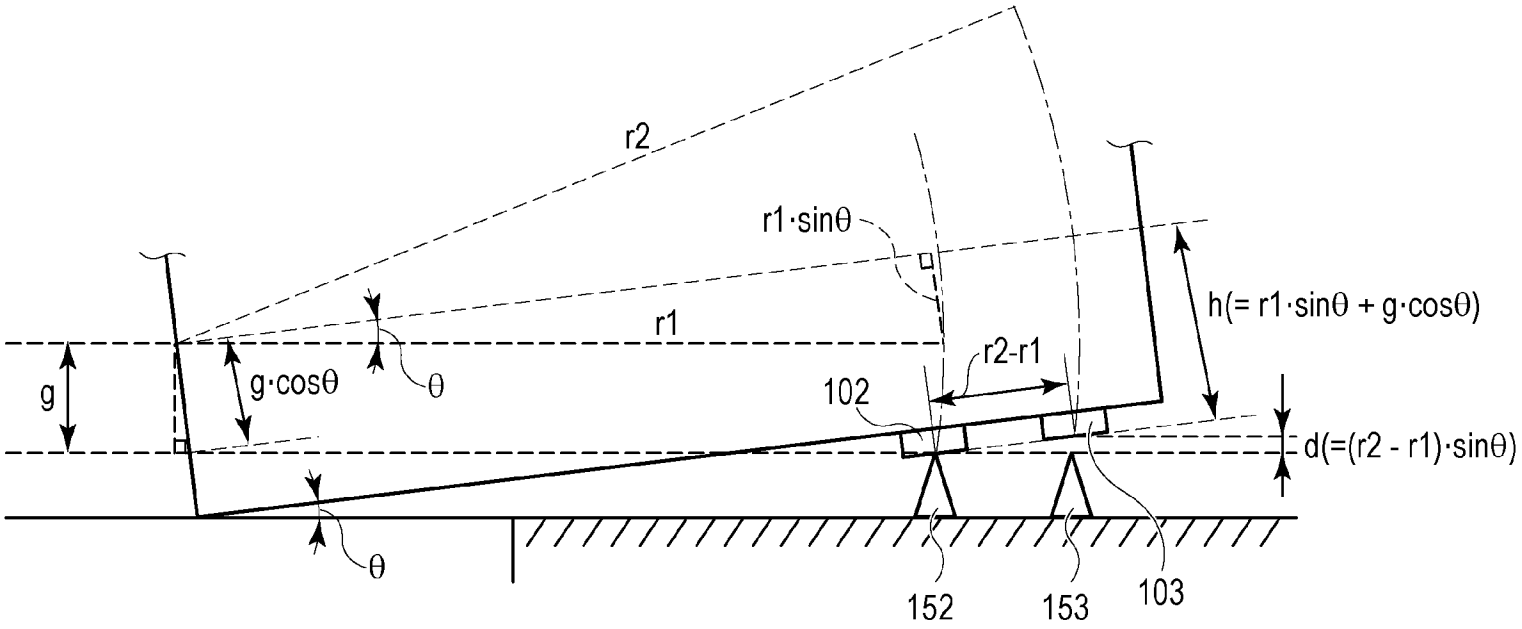
FIG. 7 is an enlarged view of an essential portion of the ink tank that is in the middle of the mount operation.

The distance h and the distance d can be expressed by the following equations (1) and (2), respectively (see FIG. 7).

$$h=r1\cdot\sin\theta+g\cdot\cos\theta \quad (1)$$

$$d=(r2-r1)\cdot\sin\theta \quad (2)$$

Since θ is obtained through a recursive calculation method, it is assumed that r1>>g, and the above equations (1) and (2) are simplified to the following equations (3) and (4).

$$h\approx r1\cdot\sin\theta \quad (3)$$

$$d\approx((r2-r1)\cdot h)/r1 \quad (4)$$

The time difference Δt from when the first contact 152 and the first electrode pads 102 have made contact with each other until the second contact 153 and the second electrode pads 103 make contact with each other, as illustrated in FIG. 6B, can be measured by a circuit that is formed by electrical connection of the above first contact 152, the first electrode pads 102, the second contact 153, and the second electrode pads 103, for example. On the basis of the time difference Δt, an operation speed (a mounting speed) v of pressing down the upper front end of the ink tank 1 in the arrow P direction can be obtained by the following equation (5).

$$v=d/\Delta t \quad (5)$$

The time difference (delay time) ΔT needed until the second engagement portion 6 and the second lock portion 156 engage with each other from immediately after the second electrode pads 103 and the second contact 153 had made contact with each other can be obtained by the following equation (6).

$$\Delta T=e/v=\Delta t(e/d) \quad (6)$$

As described above, the time difference ΔT can be computed from the actually measured time difference Δt. A timing delayed by the time difference ΔT from when the second electrode pads 103 and the second contact 153 have made contact with each other is determined with a delay circuit provided in the substrate 100 or the like. Then, by turning on the light emitting portion 101 at the timing of when the time difference ΔT as above has elapsed, the light emitting portion 101 will be turned on at the same time as the completion of mounting of the ink tank 1.

FIG. 8 is a diagram illustrating the measurement results of the time difference Δt when the lengths r1 and r2, the distances h and d, and the operation speed v have been variously changed in the exemplary configurations (from example 1 to example 9). Since in the ink tank 1 assumed to have a wide range of sizes as in examples 1 to 9, the time difference Δt is in the order of milliseconds to 10 seconds, the switching characteristics of electric circuits according to the current technology can correspond to the time difference Δt without any problem.

Figure 9A:
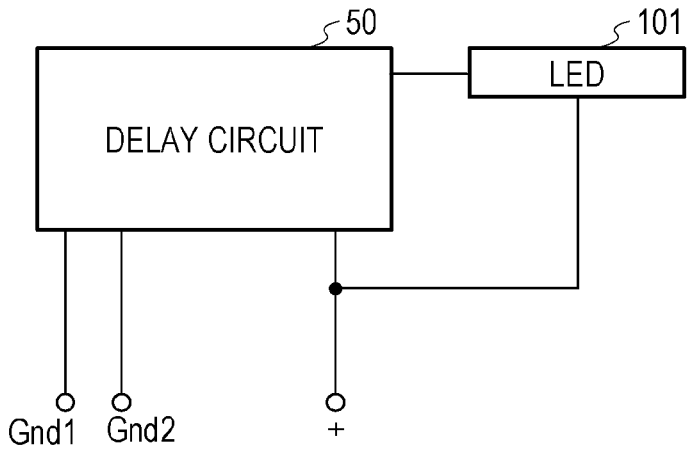
FIGS. 9A and 9B are explanatory drawings of a delay circuit.
Figure 9B:
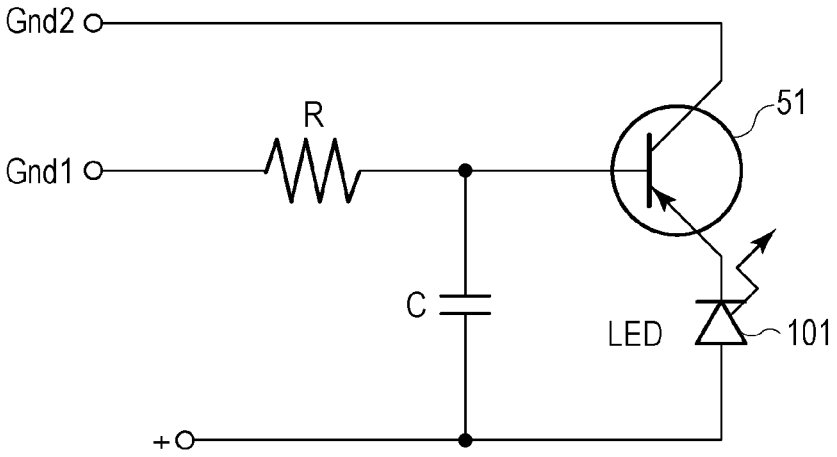

FIGS. 9A and 9B are explanatory drawings of a delay circuit 50 that makes the light emitting portion 101 emit light at a timing delayed by the time difference ΔT from the time the second electrode pads 103 come into contact with the second contact 153. In the present exemplary embodiment, an LED is used as the light emitting portion 101 and a typical CR delay circuit such as the one in FIG. 9B is used as the delay circuit 50.

The circuit between "+" and "Gnd1" of FIGS. 9A and 9B is closed upon connection between the first electrode pads 102 and the first contact 152, and "Gnd2" of FIGS. 9A and 9B is grounded upon connection between the second electrode pads 103 and the second contact 153. The time constant τ=CR of the voltage that is applied to the LED (light emitting portion) 101 changes in accordance with the time difference between the grounded time of "Gnd1" and the grounded time of "Gnd2". Furthermore, after a set time has passed after "Gnd2" has been grounded, the voltage of the CR circuit exceeds a threshold value at which a transistor 51 operates and the LED (light emitting portion) 101 is turned on. By selecting the time constant τ while associating the time constant τ with the time difference ΔT, the LED (light emitting portion) 101 can be turned on when mounting of the ink tank 1 is completed. As a result, the user can reliably recognize that the mounting of the ink tank 1 has been completed without any misunderstanding. The delay circuit 50 may be disposed on the substrate 100 of the ink tank 1 or a similar function may be given to a controller on the holder 150 side or the printing apparatus 200 side.

Other Exemplary Embodiments

As the notifying portion that notifies that the ink tank has been mounted, other than the light emitting portion that emits light, a sound emitting portion that emits sound may be used, that is, it is only sufficient that a notification operation notifying the user that the ink tank has been mounted can be performed.

Furthermore, the mount portion that is capable of mounting the ink tank is not limited to a holder that includes a print head and a print head unit. For example, the mount portion may be configured such that ink tank is mounted in a mount portion provided in the carriage or such that the ink tank is mounted in a mount portion provided at a set position in the printing apparatus. Furthermore, other than the serial scan printing apparatus, the present disclosure can be applied to various types of printing apparatuses such as a so-called full line printer. Furthermore, the print head is not limited to an inkjet print head and the print head may be any component that is capable of recording an image with ink supplied from an ink tank.

While the present disclosure has been described with reference to exemplary embodiments, it is to be understood that these exemplary embodiments are not seen to be limiting.

This application claims the benefit of Japanese Patent Application No. 2014-194728, filed Sep. 25, 2014, which is hereby incorporated by reference herein in its entirety.

What is claimed is:

1. An ink tank that is capable of being mounted on a mount portion, the ink tank comprising:

a tank side contact that is capable of being connected to a mount portion side contact provided on the mount portion; and a notifying portion controlled by a controller that is capable of performing a notification operation, wherein when the ink tank is mounted on the mount portion, the notifying portion performs the notification operation after a delay time, the delay time being set in accordance with a mounting speed of the ink tank that has elapsed from when the tank side contact has been connected to the mount portion side contact.

2. The ink tank according to claim 1, wherein the delay time becomes shorter as the mounting speed of the ink tank becomes faster.

3. The ink tank according to claim 1, wherein the mount portion side contact includes a mount portion side first contact and a mount portion side second contact, the tank side contact includes a tank side first contact that is capable of being connected to the mount portion side first contact, and a tank side second contact that is capable of being connected to the mount portion side second contact, the tank side first contact and the tank side second contact are disposed so that, when the ink tank is mounted in the mount portion, the tank side second contact is connected to the mount portion side second contact after the tank side first contact is connected to the mount portion side first contact, and the delay time varies according to a time difference between when the tank side first connector is connected to the mount portion side first contact and when the tank side second contact is connected to the mount portion side second contact.

4. The ink tank according to claim 1, further comprising a tank side engagement portion that is capable of being engaged with a mount portion side engagement portion provided on the mount portion, wherein when the ink tank is mounted on the mount portion, the tank side contact is connected to the mount portion side contact before the tank side engagement portion is engaged with the mount portion side engagement portion.

5. The ink tank according to claim 4, wherein the mount portion side engagement portion includes a mount portion side first engagement portion and a mount portion side second engagement portion, the tank side engagement portion includes a tank side first engagement portion that is capable of being engaged with the mount portion side first engagement portion, and a tank side second engagement portion that is capable of being engaged with the mount portion side second engagement portion, the tank side first engagement portion and the tank side second engagement portion are disposed so that, when the ink tank is mounted in the mount portion, the tank side second engagement portion is engaged with the mount portion side second engagement portion after the tank side first engagement portion is engaged with the mount portion side first engagement portion, and when the ink tank is mounted in the mount portion, the tank side contact is connected to the mount portion side contact during a period after the tank side first engagement portion is engaged with the mount portion side first engagement portion and before the tank side second engagement portion is engaged with the mount portion side second engagement portion.

6. The ink tank according to claim 5, wherein the tank side first engagement portion is provided on a lateral surface that is adjacent to a bottom surface of the ink tank, and the tank side second engagement portion is provided on another lateral surface that is adjacent to the bottom surface of the ink tank and that is opposite the lateral surface.

7. The ink tank according to claim 5, wherein the mount portion side first engagement portion and the mount portion side second engagement portion are each formed in a hole shape, the tank side first engagement portion is a first protrusion that is capable of being engaged with the mount portion side first engagement portion, and the tank side second engagement portion is an elastic lever provided with a second protrusion that is capable of being engaged with the mount portion side second engagement portion.

8. The ink tank according to claim 1, wherein the notifying portion is a light emitting portion that emits light to perform the notification operation.

9. The ink tank according to claim 1, further comprising a controller that controls the notifying portion.

10. A printing apparatus that includes a mount portion in which an ink tank including a notifying portion capable of performing a notification operation is mounted, the printing apparatus printing an image using a print head to which ink inside the ink tank is supplied, the printing apparatus comprising: a mount portion side contact that is located on the mount portion, the mount portion side contact being capable of being connected to a tank side contact provided on the ink tank; and a controller that controls the notifying portion, wherein when the ink tank is mounted in the mount portion, the controller makes the notification operation be performed after a delay time, the delay time being set in accordance with the mounting speed of the ink tank that has elapsed after the mount portion side contact has been connected to the tank side contact.

11. The printing apparatus according to claim 10, wherein the delay time becomes shorter as the mounting speed of the ink tank becomes faster.

12. The printing apparatus according to claim 10, wherein the tank side contact includes a tank side first contact and a tank side second contact, the mount portion side contact includes a mount portion side first contact that is capable of being connected to the tank side first contact and a mount portion side second contact that is capable of being connected to the tank side second contact, the mount portion side first contact and the mount portion side second contact are disposed so that, when the ink tank is mounted in the mount portion, the mount portion side second contact is connected to the tank side second contact after the mount portion side first contact is connected to the tank side first contact, and the delay time varies according to a time difference between when the mount portion side first contact is connected to the tank side first contact and when the mount portion side second contact is connected to the tank side second contact.

13. The printing apparatus according to claim 10, further comprising a mount portion side engagement portion that is capable of being engaged with a tank side engagement portion provided on the ink tank, wherein when the ink tank is mounted in the mount portion, the mount portion side contact is connected to the tank side contact before the mount portion side engagement portion is engaged with the tank side engagement portion.

14. The printing apparatus according to claim 13, wherein the tank side engagement portion includes a tank side first engagement portion and a tank side second engagement portion, the mount portion side engagement portion includes a mount portion side first engagement portion that is capable of being engaged with the tank side first engagement portion, and a mount portion side second engagement portion that is capable of being engaged with the tank side second engagement portion, the mount portion side first engagement portion and the mount portion side second engagement portion are disposed so that, when the ink tank is mounted in the mount portion, the mount portion side second engagement portion is engaged with the tank side second engagement portion after the mount portion side first engagement portion is engaged with the tank side first engagement portion, and when the ink tank is mounted in the mount portion, the mount portion side contact is connected to the tank side contact during a period after the mount portion side first engagement portion is engaged with the tank side first engagement portion and before the mount portion side second engagement portion is engaged with the tank side second engagement portion.

15. The printing apparatus according to claim 14, wherein the mount portion side first engagement portion is provided on an inner surface of the mount portion that opposes a lateral surface that is adjacent to a bottom surface of the ink tank, and the mount portion side second engagement portion is provided on an inner surface of the mount portion that opposes another lateral surface that is adjacent to the bottom surface of the ink tank and that is opposite the lateral surface.

16. The printing apparatus according to claim 14, wherein the tank side first engagement portion is a first protrusion, and the tank side second engagement portion is an elastic lever provided with a second protrusion, the mount portion side first engagement portion includes a first hole portion that is capable of being engaged with the first protrusion, and the mount portion side second engagement portion includes a second hole portion that is capable of being engaged with the second protrusion.

17. The printing apparatus according to claim 10, wherein the notifying portion is a light emitting portion that emits light to perform the notification operation.

18. The printing apparatus according to claim 10, wherein the mount portion is located on a carriage that is capable of mounting the print head.

19. The printing apparatus according to claim 18, wherein the mount portion is formed in a holder that is capable of being mounted in the carriage.

20. The printing apparatus according to claim 19, wherein the holder includes the print head.

* * * * *